US008185011B2

(12) United States Patent
Shibuya et al.

(10) Patent No.: US 8,185,011 B2
(45) Date of Patent: May 22, 2012

(54) CLEANING DEVICE AND IMAGE FORMING APPARATUS INCORPORATING SAME

(75) Inventors: Satoru Shibuya, Chiryu (JP); Hidetoshi Noguchi, Tahara (JP); Hisashi Murata, Toyohashi (JP); Kazuyoshi Hara, Itami (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 494 days.

(21) Appl. No.: 12/406,494

(22) Filed: Mar. 18, 2009

(65) Prior Publication Data

US 2009/0311002 A1 Dec. 17, 2009

(30) Foreign Application Priority Data

Jun. 13, 2008 (JP) ..... 2008-154959

(51) Int. Cl.
*G03G 15/00* (2006.01)
*G03G 21/00* (2006.01)
*G03G 21/10* (2006.01)

(52) U.S. Cl. ..... 399/101; 15/256.52; 399/99; 399/123; 399/353

(58) Field of Classification Search ..... 399/99, 399/101, 123, 353, 354, 355; 15/1.51, 256.51, 15/256.52
See application file for complete search history.

(56) References Cited

U.S. PATENT DOCUMENTS 5,257,075 A * 10/1993 Ohki ..... 399/51
5,329,344 A * 7/1994 Gerbasi et al. ..... 399/353
5,416,572 A * 5/1995 Kolb et al. ..... 399/350
5,623,721 A 4/1997 Lindblad et al.
5,689,791 A * 11/1997 Swift ..... 399/353
5,729,815 A * 3/1998 Lindblad et al. ..... 399/354
6,775,512 B2 * 8/2004 Thayer ..... 399/353
7,555,241 B2 * 6/2009 Shishido et al. ..... 399/128
7,693,470 B2 * 4/2010 Mori ..... 399/303
7,877,032 B2 * 1/2011 Takeuchi ..... 399/66
7,929,897 B2 * 4/2011 Sugimoto et al. ..... 399/353
2005/0058474 A1 * 3/2005 Watanabe et al. ..... 399/353

FOREIGN PATENT DOCUMENTS

JP 55083080 A * 6/1980
JP 04274477 A * 9/1992
JP 09-297519 11/1997

(Continued)

OTHER PUBLICATIONS

Office Action (Preliminary Notice of Rejection) issued in the corresponding Japanese Patent Application No. 2008-154959 dated Apr. 13, 2010, and an English Translation thereof.

*Primary Examiner* — David Gray
*Assistant Examiner* — Fred L Braun
(74) *Attorney, Agent, or Firm* — Buchanan Ingersoll & Rooney PC

(57) ABSTRACT

A first roll brush is formed from material having the positive triboelectric charge polarity against toner. A positive bias is applied to the first roll brush through a first collection roller by a first bias application device. A second roll brush is formed from material having the negative triboelectric charge polarity against toner. A negative bias is applied to the second roll brush through a second collection roller by a second bias application device. Thus, the first and second roll brushes are applied by each of biases having polarity identical to the triboelectric charge polarity of material of the roll brush against toner. This enhances cleaning performance of both the roll brushes and prevents degradation of the cleaning performance.

16 Claims, 6 Drawing Sheets

FOREIGN PATENT DOCUMENTS

| | | | | |
|---|---|---|---|---|
| JP | 10-10942 | A | | 1/1998 |
| JP | 10063162 | A | * | 3/1998 |
| JP | 2002-207403 | A | | 7/2002 |
| JP | 2002-229344 | A | | 8/2002 |
| JP | 2002278400 | A | * | 9/2002 |
| JP | 2005-077705 | | | 3/2005 |
| JP | 2006023540 | A | * | 1/2006 |
| JP | 2007-025163 | | | 2/2007 |
| JP | 2007-121568 | | | 5/2007 |
| JP | 2007321274 | A | * | 12/2007 |

* cited by examiner

CLEANING DEVICE AND IMAGE FORMING APPARATUS INCORPORATING SAME

CROSS-REFERENCE TO RELATED APPLICATION

This application is based on application No. 2008-154959 filed in Japan, the entire content of which is hereby incorporated by reference.

TECHNICAL FIELD

The present invention relates to a cleaning device for collecting toner on an image carrier of electrophotographic copying machines, printers and the like, and relates to an image forming apparatus incorporating the same.

BACKGROUND ART

Conventionally, a cleaning device for cleaning residual toner off an image carrier such as an intermediate transfer belt generally employs a method for putting a blade made of rubber in contact with a surface of the image carrier to mechanically scrape the toner off the surface, or a method for putting a bias-applied roll brush in contact with the image carrier to electrically attract the toner.

In the method for putting the bias-applied roll brush in contact with the image carrier, cleaning is performed by electrically attracting toner to the roll brush. Therefore, the toner with a polarity opposite to that of the bias applied to the roll brush is cleaned. The toner remaining on the image carrier and subjected to cleaning sometimes has a polarity charged opposite to the original polarity of the toner due to the influence of the bias (electric field) which is applied for transfer of the toner onto paper sheets or an intermediate transfer body.

This tendency is more notable in toner remaining on an intermediate transfer body when toner is transferred from the intermediate transfer body such as an intermediate transfer belt to the paper sheet than in toner remaining on a photoconductor when the toner is transferred from the photoconductor to the paper sheet. This is caused by the following reasons. That is, toner has one layer in the case of transferring the toner from the photoconductor to the paper sheet and the intermediate transfer body. On the other hand, toner has a mixture of one to four layers in the case of transferring the toner from the intermediate transfer body, e.g., an intermediate transfer belt, to the paper sheet because toner layers are superposed on top of each other on the belt. A transfer bias applied for transferring the toner including the four layer toner from the intermediate transfer body is higher than that for transferring the one layer toner from the photoconductor, and therefore, a part of one layer toner is easily influenced by this high transfer bias.

Thus, when the residual toner is cleaned with the bias-applied roll, the roll brush is not used independently, but two roll brushes which are made of an identical material are placed side by side in the rotation direction of the image carrier, as seen in cleaner devices or cleaning devices disclosed in JP H10-10942 A, JP 2002-229344 A and JP 2002-207403 A, for example. The cleaner devices or the cleaning devices further includes a toner collection roller and a scraper downstream of the roll brush, wherein the toner collection roller is for collecting the toner taken into the roll brush with use of a potential difference, and wherein the scraper is for mechanically scraping off the toner collected on the toner collection roller. In the cleaner device and the cleaning device, two biases with polarities different from each other are respectively applied to two roll brushes placed side by side, so that each of the roll brushes collects toner charged to a polarity opposite to the applied polarity.

However, there is a following problem in the conventional cleaning device using two bias-applied roll brushes.

That is, the roll brush is influenced not only by applied bias but also by electric charge caused by contacting or rubbing with toner as described below.

In triboelectric charging caused by contacting or rubbing between two substances, generally, polarities of the two substances i.e. negative and positive polarities determined by combinations of the two contacting or rubbing substances. Their polarities can be known from a charge ranking list (charging array) shown in FIG. 7. Two substances which come into contact or rub are more highly charged when their physical positions are further away from each other on the charge ranking list, whereas the two substances are not highly charged when their physical positions are close to each other.

However, the charge ranking list is not absolute but may have some changes because the triboelectric charge also depends on the surface state of materials or other environments. Base material of the toner is styrene acrylics. Since other materials such as external additive are added against the toner, the position of the toner is presumably closer to neutrality (i.e. the center) than the position of styrene acrylics on the charge ranking list shown in FIG. 7.

In brush-cleaning with use of the bias-applied roll brush, a brush fiber which constitutes the roll brush is influenced by triboelectric charges of both the toner and the intermediate transfer belt since the brush fiber has contact with both of them. However, the triboelectric charge between the brush fiber and the toner is dominant over the triboelectric charge between the brush fiber and the intermediate transfer belt because the roll brush electrically attracts the charged toner to the brush fiber so as to collect the toner.

Description is now given on the case where cleaning is performed by, for example, attracting negatively charged toner 1 to a brush fiber 2 to which a positive voltage has been applied, as shown in FIG. 8. In this case, material to be triboelectrically charged to a positive polarity against the toner 1 is used as material of the brush fiber 2. Then, the rubbing between the toner 1 and the brush fiber 2 causes the surface of the brush fiber 2 to be charged to a positive polarity and the toner 1 to be charged to a negative polarity. Thus, rubbing with the brush fiber injects the negative charge into the negatively charged toner 1, which toner is the target of cleaning. As the result, the negatively charged toner 1 is charged to be more negative. Consequently, a larger potential difference (or electric field) is generated between the toner 1 and the brush fiber 2 to which the positive voltage has been applied. Thereby, cleaning of the toner 1 is facilitated. It should be noted that in FIG. 8, a minus sign illustrated by a large letter on the central portion of the toner 1 expresses an original negative charge polarity, whereas other minus signs illustrated by a small letter express negative triboelectric charge polarity. Plus signs illustrated with a small letter in the brush fiber 2 also express positive triboelectric charge polarity.

Similarly, in the case where cleaning is performed by attracting a positively charged toner 3 to a brush fiber 4 to which a negative voltage has been applied, as shown in FIG. 9, material to be triboelectrically charged to a negative polarity against the toner 3 is used as material of the brush fiber 4. The rubbing between the toner 3 and the brush fiber 4 causes the surface of the brush fiber 4 to be charged to a negative polarity and the toner 3 to be charged to a positive polarity. Thus, rubbing with the brush fiber 4 injects the positive charge into the positively charged toner 3, which toner is the target of cleaning. As the result, the positively charged toner 1 is charged to be more positive. Consequently, a larger potential difference (or electric field) is generated between the toner 3 and the brush fiber 4 to which the negative voltage has been applied. Thereby, cleaning of the toner 3 is facilitated.

Thus, cleaning performance is enhanced by arranging that the polarity of the bias applied to the brush fibers 2 and 4 should be identical to the triboelectric charge polarity of the brush fibers 2 and 4 against the toner 1 and 3, respectively.

In the conventional cleaner device and cleaning device using two roll brushes made of identical material, as in the cases of the cleaner device and the cleaning device disclosed in JP H10-10942 A, JP 2002-229344 A and JP 2002-207403 A, biases having different polarities to each other are respectively applied to the brush fibers of two roll brushes made of an identical material, so as to collect toners having polarities opposite to the applied polarities.

Therefore, in one of the roll brushes (hereinafter referred to as a first roll brush), a polarity of the bias applied to the brush fiber is identical to a triboelectric charge polarity of the brush fiber against the toner, as shown in FIG. 8 and FIG. 9. As the result, a larger potential difference (or electric field) is generated between the toner and the brush fiber, which facilitates cleaning of the toner.

On the other hand, in the other of the roll brushes (hereinafter referred to as a second roll brush), a polarity of the bias applied to the brush fiber is different from a triboelectric charge polarity of the brush fiber against the toner.

Specifically, as shown in FIG. 10, in the case where cleaning is performed by attracting a positively charged toner 1 to a brush fiber 2 to which a negative voltage has been applied, and where material triboelectrically charged to the positive polarity against the toner 1 is used as material of the brush fiber 2, rubbing between the toner 1 and brush fiber 2 causes the surface of the brush fiber 2 to be charged to the positive polarity and the toner 1 to be charged to the negative polarity. Thus, rubbing with the brush fiber 2 causes the negative charge to be injected into the positively charged toner 1, which toner is the target of cleaning, to neutralize the positively charged toner 1. This decreases the potential difference (or electric field) between the toner 1 and the brush fiber 2 to which the negative voltage has been applied. Therefore, cleaning of the toner 1 becomes difficult and failure of cleaning may easily occur. When a large amount of negative charge is injected into the positively charged toner 1, the positively charged toner completely changes to negatively charged toner, and then, the toner remains on the intermediate transfer belt 5 without being cleaned. That is, the failure of cleaning occurs.

Similarly, as shown in FIG. 11, in the case where cleaning is performed by attracting negatively charged toner 3 to a brush fiber 4 to which a positive voltage has been applied, and where material triboelectrically charged to a negative polarity against the toner 3 is used as material of the brush fiber 4, the similar phenomenon to the above occurs. That is, rubbing with the brush fiber 4 causes the positive charge to be injected into the negatively charged toner 3, which toner is the target of cleaning, to neutralize the charge of the toner 3. Therefore, cleaning performance is degraded.

Thus, cleaning performance is degraded when a polarity of the bias applied to the brush fibers 2, 4 is different from a triboelectric charge polarity of the brush fibers 2, 4 against the toner 1, 2, respectively.

As is clear from the foregoing, in the cleaner device and cleaning device disclosed in JP H10-10942 A, JP 2002-229344 A and JP 2002-207403 A, cleaning performance is deteriorated with the second roll brush in which a polarity of the bias applied to the brush fiber is different from a triboelectric charge polarity of the brush fiber. As a result, the cleaning performance is totally deteriorated since the facilitated cleaning performance of the first roll brush is offset by the degraded cleaning performance of the second roll brush.

SUMMARY OF INVENTION

An object of the present invention is to provide an image carrier cleaning device capable of preventing degradation of the cleaning performance to clean an image carrier and an image forming apparatus incorporating the same.

In order to achieve the above-mentioned object, one aspect of the present invention provides an image carrier cleaning device which comprises a movable image carrier for carrying a toner image on a surface of the image carrier, a first roll brush including a first rotating shaft and a first brush fiber planted on the first rotating shaft so as to radially extend and have rotational contact with the surface of the image carrier, a first bias application section for applying a bias to the first roll brush, a second roll brush including a second rotating shaft and a second brush fiber planted on the second rotating shaft so as to radially extend and have rotational contact with the surface of the image carrier, the second roll brush being placed downstream of the first roll brush in a moving direction of the image carrier, and a second bias application section for applying a bias to the second roll brush, wherein a triboelectric charge polarity of the first brush fiber against the toner is different from a triboelectric charge polarity of the second brush fiber against the toner, wherein the first bias application section applies a bias having a polarity identical to the triboelectric charge polarity of the first brush fiber against the toner, and the second bias application section applies a bias having a polarity identical to the triboelectric charge polarity of the second brush fiber against the toner.

According to the above configuration, the first and second bias application sections apply biases having different triboelectric charge polarities from each other to the first and second roll brushes, respectively. Therefore, the first roll brush cleans one of positively charged toner and negatively charged toner, and the second roll brush cleans the other of positively charged toner and negatively charged toner.

Also, the first and second bias application sections respectively apply biases identical to the triboelectric charge polarities of the first and second brush fibers against the toner to the first and second roll brushes. Therefore, rubbing between the toner and the first or second brush fibers allows an electric charge having identical polarity to the original to be injected into the toner to be cleaned by the first or second roll brush. Consequently, this enlarges a potential difference between the first roll brush and the toner to be cleaned by the first roll brush and a potential difference between the second roll brush and the toner to be cleaned by the second roll brush.

Thus, performance for cleaning the toner on the image carrier can be enhanced in both the first and second roll rushes.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, embodiments of the present invention will be described in details with reference to the drawings by way of illustration.

Figure 1:
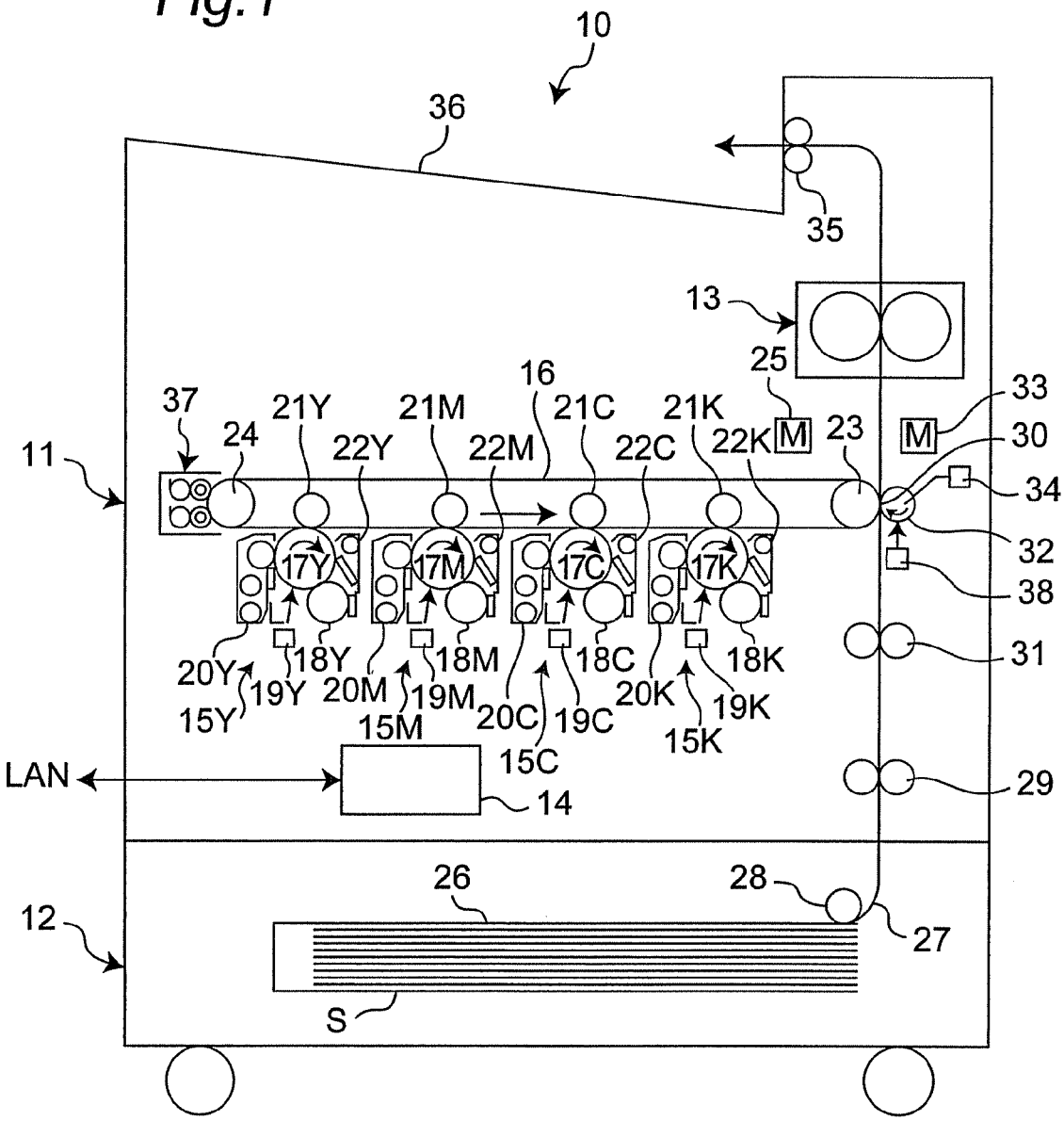
FIG. 1 shows an overall configuration of an image forming apparatus mounted with an image carrier cleaning device of the invention.

FIG. 1 shows an image forming apparatus mounted with an image carrier cleaning device according to a first embodiment. Description is now given on a tandem-type color digital printer (hereinafter simply referred to as a "printer") as an example of the image forming apparatus, with reference to FIG. 1.

The printer 10 includes an image processing section 11, a feed section 12, a fixing section 13 and a control section 14, as shown in FIG. 1, to form images by using a known electrophotographic method. The printer 10 is connected to a network made of e.g. LAN (Local Area Network). Upon receiving an execution instruction of a print job from an external terminal unit (not shown), the printer 10 forms a color image composed of yellow, magenta, cyan, and black colors in response to the execution instruction. Hereinafter, reproduced colors of yellow, magenta, cyan and black are respectively expressed as Y, M, C and K. Any component associated with one of the reproduced colors is designated by a reference numeral with Y, M, C or K added thereto.

The image processing section 11 includes imaging sections 15Y, 15M, 15C and 15K respectively corresponding to reproduced colors Y, M, C and K, an intermediate transfer belt 16 and so on.

The imaging section 15Y to 15K includes photoconductor drums 17Y to 17K, chargers 18Y to 18K, exposure sections 19Y to 19K, developing devices 20Y to 20K, primarily transfer rollers 21Y to 21K and cleaners 22Y-22K for cleaning the photoconductor drums 17Y to 17K, which are placed around the photoconductor drums 17Y to 17K. Toner images of reproduced colors Y, M, C and K are formed on the photoconductor drums 17Y to 17K, respectively. The exposure section 19Y has a laser diode, a polygon mirror, a scanning lens and so on in the exposure section 19Y, wherein the polygon mirror deflects a laser beam emitted from the laser diode to scan and expose the surface of the photoconductor drum 17Y in a main scanning direction. Other exposure sections 19M to 19K have the similar configuration.

The intermediate transfer belt 16 as an image carrier, which belt constitutes a part of the image processing section 11, is an endless belt. The intermediate transfer belt 16 is stretched by a driving roller 23 and a driven roller 24. The intermediate transfer belt 16 is rotated in an arrow direction by a belt driving motor 25.

The feed section 12 includes a picture paper cassette 26, a supply roller 28, a pair of conveying rollers 29, a pair of timing rollers 31 and a secondary transfer roller 32. The picture paper cassette 26 stores paper sheets S as recording sheets. The supply roller 28 supplies paper sheets S in the picture paper cassette 26 one by one to a conveying path 27. The pair of conveying rollers 29 convey the applied paper sheets S. The pair of timing rollers 31 is for taking the timing of sending out the paper sheets S to a secondary transfer position 30. The secondary transfer roller 32 is put in pressure contact with a driving roller 23 via the intermediate transfer belt 16 at the secondary transfer position 30.

The secondary transfer roller 32 is a conductive elastic roller foamed by, for example, adding ion conductive substances to NBR (nitrile rubber). The secondary transfer roller 32 is driven by a secondary transfer roller driving motor 33 so as to rotate in an arrow direction shown in FIG. 1. A secondary transfer voltage outputted from a secondary transfer voltage output section 34 is applied to the secondary transfer roller 32. Thereby, the electrostatic force for secondary transfer is generated between the secondary transfer roller 32 and the driving roller 23.

The fixing section 13 has a fixing roller and a pressure roller so that the paper sheets S is heated at a predetermined fixing temperature under pressure so as to fix a toner image.

The control section 14 converts an image signal from the external terminal unit into digital signals for respective reproduced colors Y, M, C and K, so as to generate driving signals for driving the laser diodes of the exposure sections 19Y to 19K. Then, the generated driving signals drives the laser diodes of the exposure sections 19Y to 19K, so that laser beams are emitted for scanning and exposing the photoconductor drums 17Y to 17K.

The photoconductor drums 17Y to 17K has been uniformly charged in advance by the chargers 18Y to 18K before scanning for exposure are performed by the exposure sections 19Y to 19K. The scanning for exposure by using the laser beams L from the exposure sections 19Y to 19K allows forming electrostatic latent images on the photoconductor drums 17Y to 17K.

Each of the electrostatic latent images is developed with toner by the developing devices 20Y to 20K. Thus-obtained toner images on the photoconductor drums 17Y to 17K are primarily transferred onto the intermediate transfer belt 16 by the electrostatic force which has been generated between the primary transfer rollers 21Y to 21K and the photoconductor drums 17Y to 17K. In this case, imaging operations of respective colors are performed at shifted timings so as to superpose the toner images of respective colors at a same position on the intermediate transfer belt 16. The toner images of respective colors, which are superposed i.e. primarily transferred onto the intermediate transfer belt 16, are then moved to a secondary transfer position 30 by rotation of the intermediate transfer belt 16.

On the other hand, paper sheets S are fed from the feed section 12 by a pair of the timing rollers 31 in synchronization with the timing of the above-mentioned imaging operations of the respective colors on the intermediate transfer belt 16. The paper sheets S are conveyed while being placed between the intermediate transfer belt 16 and the secondary transfer roller 32. At that time, the toner images on the intermediate transfer belt 16 are secondarily transferred onto the paper sheet S correctively by the electrostatic force generated between the secondary transfer roller 32 and the driving roller 23.

The paper sheet S passed through the secondary transfer position 30 is conveyed to the fixing section 13. The toner images are fixed by application of heat and pressure at the fixing section 13. Thereafter, the paper sheet S is discharged by a discharge roller 35 and stored in a storage tray 36.

The toner remaining on the intermediate transfer belt 16 without being secondarily transferred onto the paper sheet S at the secondary transfer position 30 is cleaned by an image carrier cleaning device (hereinafter simply referred to as a "cleaning device") which is provided in such a way as to face the driven roller 24. If the toner remaining on the intermediate transfer belt 16 is attached to the secondary transfer roller 32 which contacts with the intermediate transfer belt 16, then the secondary transfer roller 32 is contaminated with the toner. The toner contamination on the secondary transfer roller 32 is detected by a contamination detection sensor 38.

Detailed description is now given on configuration and operation of the cleaning device 37 which has main technical features of the printer 10.

Figure 2:
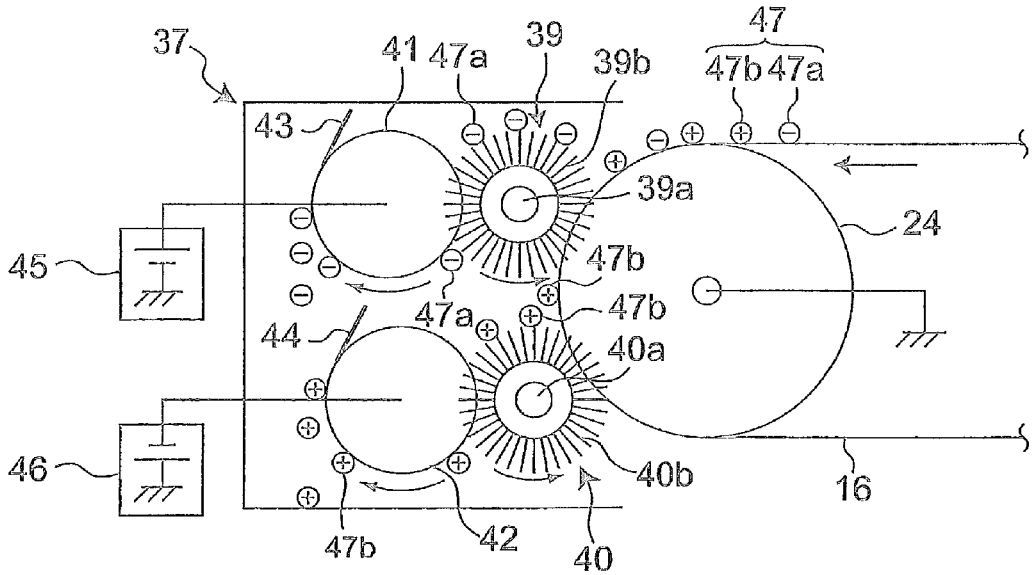
FIG. 2 shows a schematic cross sectional configuration of the image carrier cleaning device shown in FIG. 1.

FIG. 2 shows a schematic cross sectional view of the cleaning device 37. As shown in FIG. 2, a first roll brush 39 having brush fiber 39*b* is placed so that the tip of the brush fiber 39*b* may have contact with the surface of the intermediate transfer belt 16 which rotates around the driven roller 24. The brush fiber 39*b* is planted in the radial direction around a rotating shaft 39*a* placed parallel to the driven roller 24. A second roll brush 40 having brush fiber 40*b* is also placed downstream of the first roll brush 39 so that the tip of the brush fiber 40*b* may have contact with the surface of intermediate transfer belt 16 which rotates around the driven roller 24. Thus, when the rotating shafts 39*a* and 40*a* are rotated, the tips of the brush fibers 39*b* and 40*b* brush the surface of the intermediate transfer belt 16. In this case, both the first roll brush 39 and the second roll brush 40 are rotated in the direction opposite to the moving direction of the intermediate transfer belt 16 (i.e., the rotational direction of the driven roller 24).

On the opposite side of the driven roller 24 via the first roll brush 39, a rotatable first toner collection roller 41 made of metal is placed parallel to the first roll brush 39 so as to have contact with the tip of the brush fiber 39*b* of the first roll brush 39. Similarly, on the opposite side of the driven roller 24 via the second roll brush 40, a rotatable second toner collection roller 42 made of metal is placed parallel to the second roll brush 40 so as to have contact with the tip of the brush fiber 40*b* of the second roll brush 40. In FIG. 2, the first and second toner collection rollers 41, 42 are rotated in the forward direction with respect to the first and second roll brushes 39, 40, respectively. However, they may be rotated in the counter direction.

An edge of a first scraper 43 contacts with the surface of the first toner collection roller 41. Similarly, an edge of a second scraper 44 contacts with the surface of the second toner collection roller 42.

The cleaning device 37 in the present embodiment brings the bias-applied brush fibers 39*b*, 40*b* of the first, second roll brushes 39, 40 into contact with the intermediate transfer belt 16, so that the first, second roll brushes 39, 40 electrically attract the residual toner on the intermediate transfer belt 16 to clean the intermediate transfer belt 16. The toner taken by the brush fibers 39*b*, 40*b* of the first, second roll brushes 39, 40 is collected by the first, second toner collection rollers 41, 42 with use of a potential difference between the first and second toner collection rollers 41, 42. The toner collected on the first, second toner collection rollers 41, 42 is mechanically scraped off by the first, second scrapers 43, 44.

Bias application to the first roll brush 39 is performed through the metal first toner collection roller 41 to which a positive voltage has been applied by using a first bias application device 45. Similarly, bias application to the second roll brush 40 is performed through the metal second toner collection roller 42 to which a negative voltage has been applied by using a second bias application device 46.

In the present embodiment, cleaning performance is enhanced by making the polarity of the bias applied to the brush fibers 39*b*, 40*b* of the first, second roll brushes 39, 40 identical to the polarity of triboelectric charge of the brush fibers 39*b*, 40*b* against the toner.

Based on experimental results, description is given on that the cleaning performance is enhanced by making the polarity of the bias applied to the brush fiber identical to the polarity of triboelectric charge of the brush fiber against the toner, in comparison with the case where the applied bias polarity is made opposite to the triboelectric charge polarity.

Figure 3:
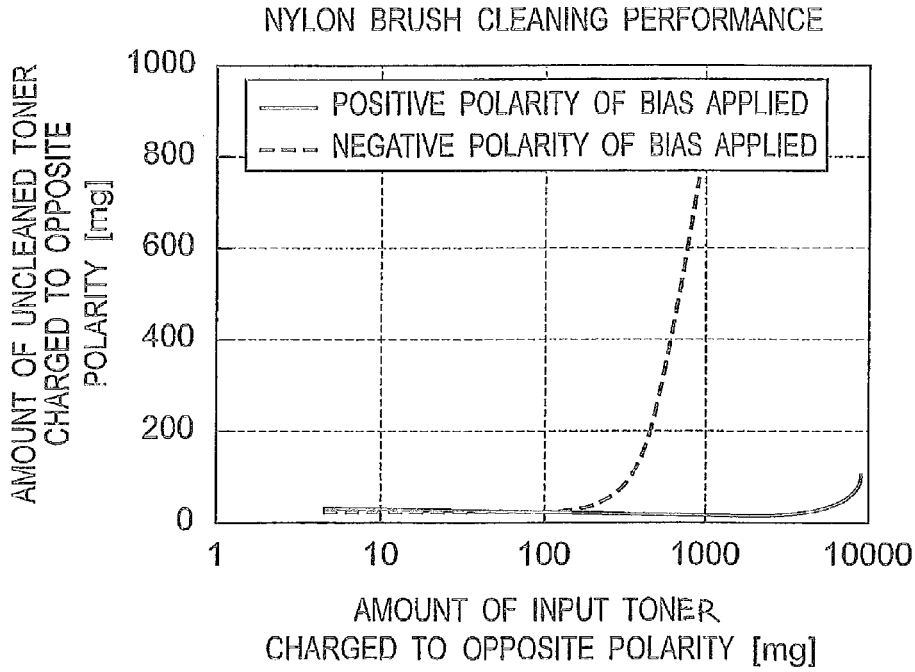
FIG. 3 shows a cleaning performance of a roll brush made of nylon.

FIG. 3 shows the cleaning performance of a nylon roll brush for cleaning toner, wherein nylon is material having a highly positive polarity of triboelectric charge against toner. A horizontal axis represents the amount of toner to be cleaned (input toner amount) on the intermediate transfer belt. Specifically, the horizontal axis represents the amount of toner having a polarity opposite to the polarity of bias applied to the roll brush. A vertical axis represents the amount of uncleaned toner. Specifically, the vertical axis represents the amount of toner which remains on the intermediate transfer belt after the roll brush passes and is charged to a polarity opposite to the polarity of bias applied to the roll brush.

In FIG. 3, a solid line represents the cleaning performance in the case where the polarity of bias applied to the roll brush is positive (i.e., the applied bias polarity is identical to the triboelectric charge polarity of the roll brush). On the other hand, a dashed line represents the cleaning performance in the case where the polarity of bias applied to the roll brush is negative (i.e., the applied bias polarity is opposite to the triboelectric charge polarity of the roll brush).

Specifically, a toner image (two-layer solid image) is primarily transferred onto the intermediate transfer belt with use of MFT "bizhub C550" made by Konica Minolta. Then, the primarily transferred toner image is secondarily transferred onto a paper sheet while the application intensity of the secondary transfer bias is varied. After the secondary transfer, the remaining toner on the intermediate transfer belt is then cleaned by using a tester in which a cleaning device equipped with one nylon roll brush is movably placed.

Regarding the toner to be cleaned and the toner remaining uncleaned on the intermediate transfer belt, the charge amount distributions, and the ratio between positively charged toner and negatively charged toner were measured by using "Espart Analyzer" made by Hosokawa Micron Corporation. Also, the toner in a definite area on the intermediate transfer belt was sucked and the weight thereof was measured so as to determine the amount of positively charged toner and the amount of negatively charged toner. In this case, as mentioned above, the amount of positively charged toner, the amount of negatively charged toner, and the ratio thereof are changed by varying the application intensity of the secondary transfer bias.

In this experiment, the physical characteristics of the nylon used for the roll brush are as follows: material: nylon; fineness: 2 denier; density: 240 kF/in$^2$ (kilo-filaments/in$^2$); raw yarn resistance: 11.5 Log Ω; outer diameter: 21.6 mm Φ; and pile length: 3.6 mm. The experimental conditions are: biting amount of roll brush by belt: 1.3 mm; and applied current (constant current): 10 μA.

As shown in FIG. 3, the experimental result indicates that cleaning performance is better because the amount of uncleaned toner is smaller in the case (solid line) where the positive bias has been applied to the roll brush. The positive bias has a polarity identical to the triboelectric charge polarity of nylon against the toner. When the input toner amounts are up to about 200 mg, the amounts of uncleaned toner are generally the same in both the case (solid line) where a positive bias has been applied to the roll brush and the case (dashed line) where a negative bias has been applied to the roll brush. This is because mechanical cleaning of the intermediate transfer belt by the roll brush is dominant in this region.

Figure 4:
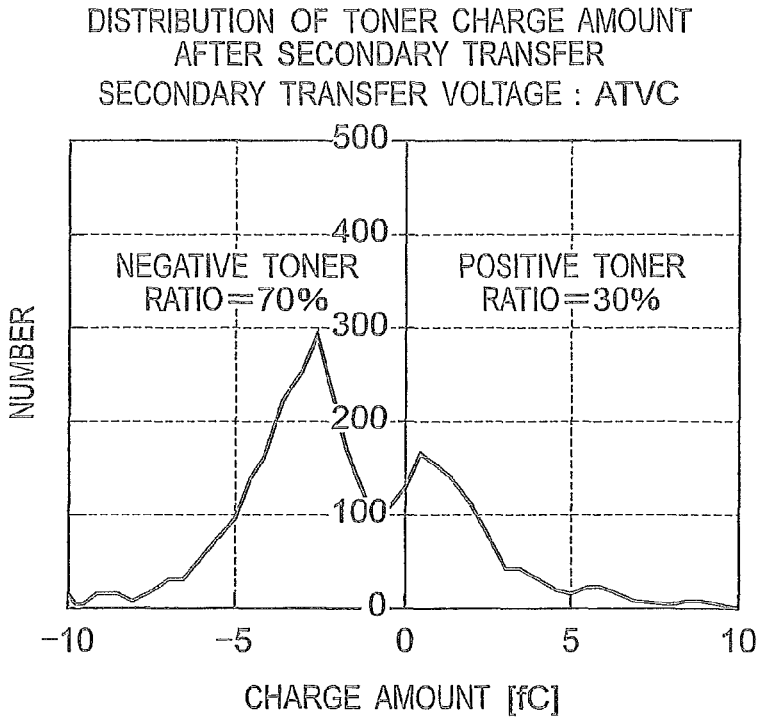
FIG. 4 shows a distribution of toner charge amounts after secondary transfer.

FIG. 4 shows distribution of the toner charge amount after secondary transfer. When the secondary transfer bias is under an appropriate condition, the transfer rate is high. Therefore, the amount of the toner to be cleaned by the tester (cleaning device) i.e. the amount of secondary transfer residual toner is the least. In the charge amount distribution shown in FIG. 4, positively charged toner amount:negatively charged toner amount=3:7. Thus, around 70 percent of all the residual toners can be removed by applying a positive bias to the first roll brush 39 as shown in FIG. 3, which brush is positioned upstream of the moving direction of the intermediate transfer belt. It should be noted that the positively charged toner is toner which is turned to positive by injection of charge in the primary transfer operation and so on.

In contrast, when the secondary transfer bias is under an insufficient condition, untransferred toner increases. This leads to increase in the amount and the ratio of the negatively charged toner. On the other hand, when the secondary transfer bias is under an excessive condition, the toner turned to positive increases. This leads to increase in the amount and the ratio of the positively charged toner.

Figure 5:
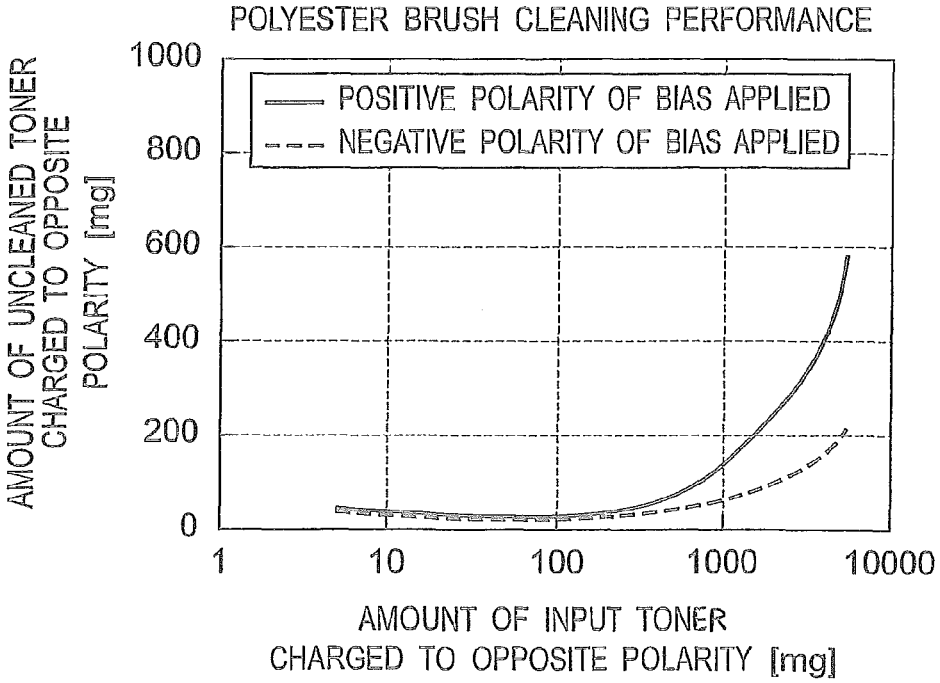
FIG. 5 shows a cleaning performance of a roll brush made of polyester.

Similar to FIG. 3, FIG. 5 shows the cleaning performance to clean the toner with a roll brush using polyester. Polyester is material considered to have a slightly negative triboelectric charge polarity against the toner. It should be noted that the horizontal axis and the vertical axis are the same as those in FIG. 3.

In this experiment, the physical characteristics of polyester used for the roll brush are as follows: material: polyester; fineness: 2 denier; density: 240 kF/in$^2$; raw yarn resistance: 11.5 Log Ω; outer diameter: 21.6 mm Φ; and pile length: 3.6 mm. The experimental conditions are: biting amount of roll brush by belt: 1.3 mm; and applied current (constant current): 10 μA.

Figure 7:
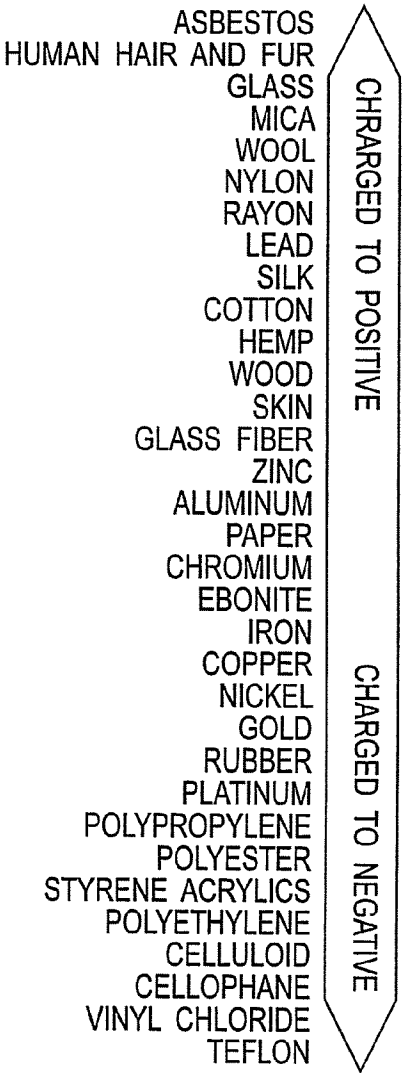
FIG. 7 shows a charge ranking list.
Figure 8:
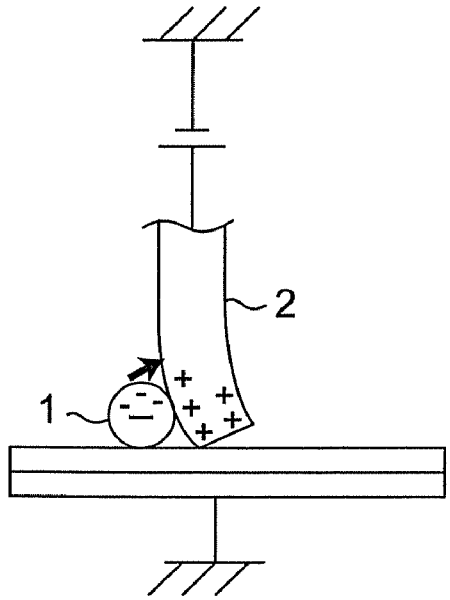
FIG. 8 is an illustration for explaining transfer of charge to toner related to cleaning performance when a positive voltage has been applied to a brush fiber and a triboelectric charge of the brush fiber against toner is positive.
Figure 9:
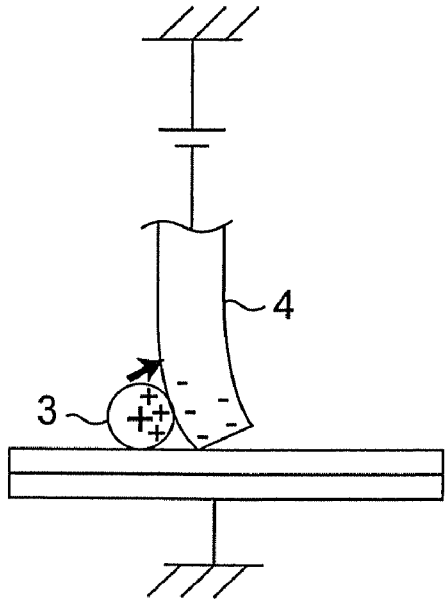
FIG. 9 is an illustration for explaining transfer of charge to toner related to cleaning performance when a negative voltage has been applied to the brush fiber and the triboelectric charge of the brush fiber against the toner is negative.
Figure 10:
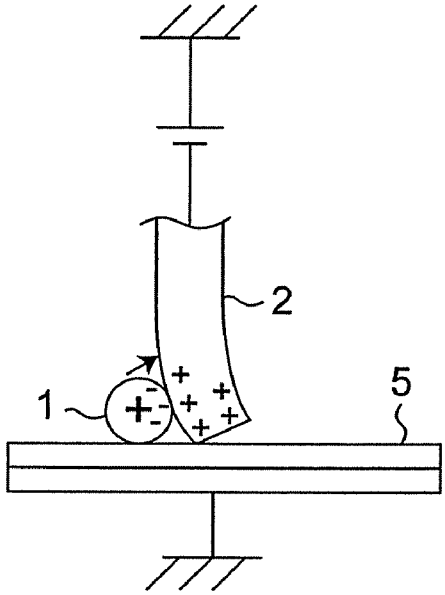
FIG. 10 is an illustration for explaining transfer of charge to toner related to cleaning performance when a negative voltage has been applied to the brush fiber and the triboelectric charge of the brush fiber against the toner is positive.
Figure 11:
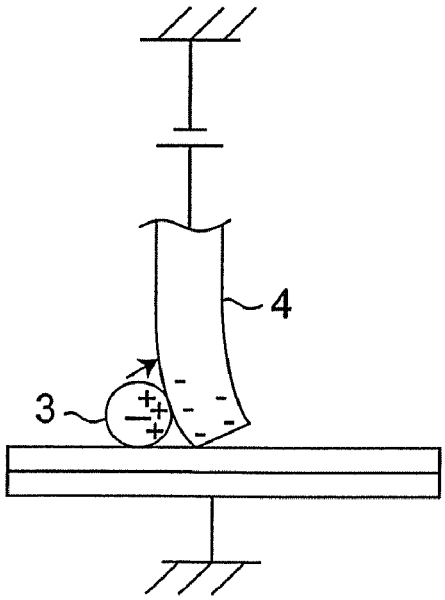
FIG. 11 is an illustration for explaining transfer of charge to toner related to cleaning performance when a positive voltage has been applied to the brush fiber and the triboelectric charge of the brush fiber against the toner is negative.

As shown in FIG. 5, the experimental result indicates that cleaning performance is better because the amounts of uncleaned toner are smaller in the case (dashed line) where the negative bias has been applied to the roll brush. The negative bias has a polarity identical to the triboelectric charge polarity of polyester against the toner, similar to the case of nylon. However, polyester is not strongly influenced by a triboelectric charge against toner because polyester for the roll brush and styrene acrylics for the toner have close physical relationship to each other on the charge ranking list shown in FIG. 7. Thus, the difference between positive bias and negative bias each of which is applied to the polyester roll brush applied is not so large as the difference therebetween applied to nylon roll brush. Similarly, the mechanical cleaning of the intermediate transfer belt by the roll brush is dominant in the region up to about 200 mg of the input toner amount.

Description is now given on a method for applying a bias. Specifically, it is the method for applying biases to the brush fibers 39*b*, 40*b* in the cleaning device 37 shown in FIG. 2, wherein each of the biases has a polarity identical to the triboelectric charge polarity of each of the brush fibers 39*b*, 40*b* against toner.

Two cases can be considered in bias application to the first and second roll brushes 39, 40. In the first case, a positive bias is applied to the first roll brush 39 positioned upstream in the rotation direction of the intermediate transfer belt 16 whereas a negative bias is applied to the second roll brush 40 positioned downstream. In the second case, reversely, a negative bias is applied to the first roll brush 39 positioned upstream whereas a positive bias is applied to the second roll brush 40 positioned downstream. Hereinbelow, advantages of both the cases are explained by use of examples.

EXAMPLE 1

In this example, a positive bias has been applied to the brush fiber 39*b* of the first roll brush 39, while a negative bias has been applied to the brush fiber 40*b* of the second roll brush 40.

In this case, materials having a positive triboelectric charge polarity against toner such as nylon and rayon are used as material of the brush fiber 39*b* of the first roll brush 39. In those cases, the raw yarn resistance of the brush fiber 39*b* is 10 Log Ω to 13 Log Ω. Herein, the raw yarn resistance is defined as a fiber resistance per unit length of fiber (for example, 30 cm). Also, the fineness of raw yarn is preferably 1 denier to 6 deniers. The density thereof is preferably 180 kF/in$^2$ to 250 kF/in$^2$ when the fineness is 2 deniers for example, though the density varies depending on the fineness.

When the raw yarn resistance is smaller than "10 Log Ω", it is impossible to obtain a potential difference between the toner and the brush fiber 39*b* of such a degree that allows facilitated cleaning of the negatively charged toner remaining on the intermediate transfer belt 16. When the raw yarn resistance is larger than "13 Log Ω", electric discharge may be generated between the toner and the brush fiber 39*b*.

A positive bias is applied to the first roll brush 39 via the first toner collection roller 41 by using the first bias application device 45. The bias intensity is 5 μA to 20 μA in the case of constant current control or 300V to 1500V in the case of constant voltage control, for example.

In the above configuration, first, the toner 47*a* charged to a negative polarity on the intermediate transfer belt 16 is moved to the brush fiber 39*b* charged to a positive polarity. The above-stated movement of the toner 47*a* is caused by the electric field generated between the intermediate transfer belt 16 and the brush fiber 39*b*. Next, the toner 47*a* on the brush fiber 39*b* is moved to the first toner collection roller 41 so as to be collected. This is because an electric field is also generated between the brush fiber 39*b* and the first toner collection roller 41 since a bias has been applied to the first roll brush 39 via the first toner collection roller 41. Then, the toner 47*a* collected on the first toner collection roller 41 is scraped off by the first scraper 43.

In this way, the negatively charged toner 47*a* remaining on the intermediate transfer belt 16 is cleaned by the brush fiber 39*b* of the first roll brush 39. Material having the positive triboelectric charge polarity against toner, such as nylon or rayon, is used as material of the brush fiber 39*b*, and a positive bias is applied to the first roll brush 39. Thus, the negatively charged toner 47*a* is charged to be more negative by injection of a negative charge due to rubbing with the brush fiber 39*b*. Consequently, a larger potential difference (a larger electric field) is generated between the toner 47*a* and the brush fiber 39*b*, so that the negatively charged toner 47*a* remaining on the intermediate transfer belt 16 is cleaned easily. As a result, toner remaining on the intermediate transfer belt 16 is only the positively charged toner 47*b*.

Contrary to the foregoing, material having the negative triboelectric charge polarity against toner, such as polyester, polyethylene or Teflon, is used as material of the brush fiber 40*b* in the second roll brush 40. The raw yarn resistance, the raw yarn fineness, and the raw yarn density of the brush fiber 40*b* in this case is preferably similar to those of the brush fiber 39*b* in the first roll brush 39.

A negative bias is applied to the second roll brush 40 via the second toner collection roller 42 by using the second bias application device 46. The bias intensity in this case is −5 μA to −20 μA in the case of constant current control and −300V to −1500V in the case of constant voltage control, for example.

In the above configuration, first, the toner 47*b* charged to a positive polarity on the intermediate transfer belt 16 is moved to the brush fiber 40*b* charged to a negative polarity. The above-stated movement of the toner 47*b* is caused by the electric field generated between the intermediate transfer belt 16 and the brush fiber 40*b*. Next, the toner 47*b* on the brush fiber 40*b* is moved to the second toner collection roller 42 so as to be collected. This is because an electric field is also generated between the brush fiber 40*b* and the second toner collection roller 42 since a bias has been applied to the second roll brush 40 via the second toner collection roller 42. Then, the toner 47*b* collected on the second toner collection roller 42 is scraped off by the second scraper 44.

In this way, the positively charged toner 47*b* remaining on the intermediate transfer belt 16 is cleaned by the brush fiber 40*b* of the second roll brush 40. Material having negative triboelectric charge polarity against toner, such as polyester, polyethylene and Teflon, is used as material of the brush fiber 40*b*, and a negative bias has been applied to the second roll brush 40. Thus, the positively charged toner 47*b* is charged to be more positive by injection of a positive charge due to rubbing with the brush fiber 40*b*. Consequently, a larger potential difference (a larger electric field) is generated between the toner 47*b* and the brush fiber 40*b*, so that the positively charged toner 47*b* remaining on the intermediate transfer belt 16 is cleaned easily. As a result, all the toner remaining on the intermediate transfer belt 16 is cleaned.

Electric charge, which is generated from a secondary transfer bias applied to the secondary transfer roller 32, is not injected into the toners 47*a* and 47*b* to be cleaned on the intermediate transfer belt 16 unless there are irregular occurrences such as paper sheet S being moist. Consequently, as shown in FIG. 4, about 70 percent of the toner 47 stays as a negatively charged toner, while about 30 percent of the toner 47 changes to a positively charged toner 47*b* since a positive charge is injected during primary transfer. Herein, the toners 47*a* and 47*b* are generically referred to as toner 47, wherein the toner 47*a* is charged to a negative polarity and the toner 47*b* is charged to a positive polarity, as stated above.

Thus, a positive bias is applied to the first roll brush 39 and a negative bias is applied to the second roll brush 40, wherein the first roll brush 39 is positioned upstream in the rotation direction of the intermediate transfer belt 16 and the second roll brush 40 is positioned downstream, as already stated above. This makes it possible to firstly clean the negatively charged toner 47*a* of about 70 percent and secondly clean the remaining positively charged toner 47*b* of about 30 percent. In this way, efficient cleaning is achieved.

A larger amount of toner on the intermediate transfer belt than usual needs to be cleaned in the case of startup operation, periodical image stabilization processing and jam processing. Most toner in this case is negatively charged due to not yet transferred one.

In the case of the image stabilization processing and the jam processing, therefore, the larger amount of toners is efficiently cleaned by applying a sufficiently higher positive bias to the brush fiber 39*b* of the first roll brush 39 than usual with a special sequence provided. Even if toner remains which has not been cleaned, a positive charge is injected into the remaining toner because the bias is set to be high. Thus, the positively charged toner which has passed through the upstream first roll brush 39 can be entirely cleaned by the negative-bias-applied brush fiber 40*b* of the downstream second roll brush 40 with a cleaning sequence set up.

EXAMPLE 2

In this example, a negative bias has been applied to the brush fiber 39*b* of the first roll brush 39, while a positive bias has been applied to the brush fiber 40*b* of the second roll brush 40.

In this case, materials having a negative triboelectric charge polarity against toner such as polyester, polyethylene and Teflon are used as material of the brush fiber 39*b* of the first roll brush 39. In those cases, the raw yarn resistance of the brush fiber 39*b* is 10 Log Ω to 13 Log Ω. Also, the fineness of raw yarn is preferably 1 denier to 6 deniers. The density thereof is preferably 180 kF/in$^2$ to 250 kF/in$^2$ when the fineness is 2 deniers for example, though the density varies depending on the fineness.

When the raw yarn resistance is smaller than "10 Log Ω", it is impossible to obtain a potential difference between the toner and the brush fiber 39*b* of such a degree that allows facilitated cleaning of the positively charged toner remaining on the intermediate transfer belt 16. When the raw yarn resistance is larger than "13 Log Ω", electric discharge may be generated between the toner and the brush fiber 39*b*.

In this example 2, contrary to the case of FIG. 2, the first toner collection roller 41 is electrically connected to the second bias application device 46 while the second toner collection roller 42 is electrically connected to the first bias application device 45. A negative bias is applied to the first roll brush 39 by using the second bias application device 46 via the first toner collection roller 41. The bias intensity is −5 μA to −20 μA in the case of constant current control or −300V to −1500V in the case of constant voltage control, for example.

In the above configuration, first, the toner charged to a positive polarity on the intermediate transfer belt 16 is moved to the brush fiber 39*b* charged to a negative polarity. The above-stated movement of the toner is caused by the electric field generated between the intermediate transfer belt 16 and the brush fiber 39*b*. Next, the positively-charged toner on the brush fiber 39*b* is moved to the first toner collection roller 41 so as to be collected. This is because an electric field is also generated between the brush fiber 39*b* and the first toner collection roller 41 since a bias has been applied to the first roll brush 39 via the first toner collection roller 41. Then, the positively-charged toner collected on the first toner collection roller 41 is scraped off by the first scraper 43.

In this way, the positively charged toner remaining on the intermediate transfer belt 16 is cleaned by the brush fiber 39*b* of the first roll brush 39. Material having the negative triboelectric charge polarity against toner, such as polyester, polyethylene or Teflon, is used as material of the brush fiber 39*b*, and a negative bias has been applied to the first roll brush 39. Thus, the positively charged toner is charged to be more positive by injection of a positive charge due to rubbing with the brush fiber 39*b*. Consequently, a larger potential difference (a larger electric field) is generated between the toner and the brush fiber 39*b*, so that the positively charged toner remaining on the intermediate transfer belt 16 is cleaned easily. As a result, toner remaining on the intermediate transfer belt 16 is only the negatively charged toner.

Contrary to the foregoing, material having a positive triboelectric charge polarity against toner, such as nylon or rayon, is used as material of the brush fiber 40*b* in the second roll brush 40. The raw yarn resistance, the raw yarn fineness, and the raw yarn density of the brush fiber 40*b* in this case is preferably similar to those of the brush fiber 39*b* in the first roll brush 39.

Figure 6:
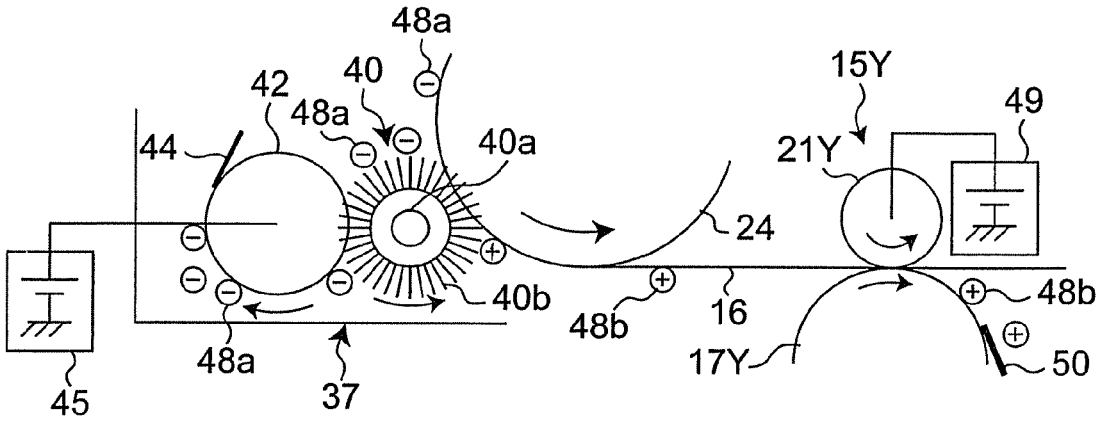
FIG. 6 is an illustration for explaining cleaning of toner passing through a second roll brush when a positive bias has been applied to the second roll brush.

A positive bias is applied to the second roll brush 40 via the second toner collection roller 42 by using the first bias application device 45, as shown in FIG. 6. The bias intensity in this case is 5 μA to 20 μA in the case of constant current control or 300V to 1500V in the case of constant voltage control, for example.

In the above configuration, first, the toner 48*a* charged to a negative polarity on the intermediate transfer belt 16 is moved to the brush fiber 40*b* charged to a positive polarity. The above-stated movement of the toner 48*a* is caused by the electric field generated between the intermediate transfer belt 16 and the brush fiber 40*b*. Next, the toner 48*a* on the brush fiber 40*b* is moved to the second toner collection roller 42 so as to be collected. This is because an electric field is also generated between the brush fiber 40*b* and the second toner collection roller 42 since a bias has been applied to the second roll brush 40 via the second toner collection roller 42. Then, the toner 48*a* collected on the second toner collection roller 42 is scraped off by the second scraper 44.

In this way, the negatively charged toner 48*a* remaining on the intermediate transfer belt 16 is cleaned by the second roll brush 40. Material having the positive triboelectric charge polarity against toner, such as nylon or rayon, is used as material of the brush fiber 40*b*, and a positive bias has been applied to the second roll brush 40. Thus, the negatively charged toner 48*a* is charged to be more negative by injection of a negative charge due to rubbing with the brush fiber 40*b*. Consequently, a larger potential difference (a larger electric field) is generated between the toner and the brush fiber 40*b*, so that the negatively charged toner 48*a* remaining on the intermediate transfer belt 16 is cleaned easily. As a result, all the toner remaining on the intermediate transfer belt 16 is cleaned.

When the toner on the intermediate transfer belt 16 cannot be cleaned even by both the first roll brush 39 and the second roll brush 40, the uncleaned toner 48*b* passing through the second roll brush 40 is charged to a positive polarity, as shown in FIG. 6. This is because when the toner passes the brush fiber 40*b* of the second roll brush 40, a positive electric charge is injected into the toner by the electric field which is caused by the positive bias applied to the second roll brush 40. The positively charged toner 48*b* on the intermediate transfer belt 16 reaches the imaging section 15Y after passing out through the second roll brush 40.

At a primary transfer position of yellow in the imaging section 15Y, a positive bias has been applied to the primarily transfer roller 21Y by a primary transfer bias application device 49, so that the surface of the photoconductor drum 17Y has been charged to a negative polarity. Accordingly, the toner 48*b* charged to a positive polarity after passing through the second roll brush 40 is reversely transferred onto the photoconductor drum 17Y at the primary transfer position. Therefore, the toner 48*b* can be collected by a cleaning device (e.g., a scraper) 50 of the photoconductor drum 17Y, which makes it possible to provide further sufficient cleaning performance.

The example 1 and the example 2 have different advantages from each other. As described above, in the example 1, a positive bias has been applied to the brush fiber 39*b* of the first roll brush 39, while a negative bias has been applied to the brush fiber 40*b* of the second roll brush 40. In the example 2, a negative bias has been applied to the brush fiber 39*b* of the first roll brush 39, while a positive bias has been applied to the brush fiber 40*b* of the second roll brush 40. Thus, either the example 1 or the example 2 may be selected according to the characteristics etc. of the printer 10 to which this cleaning device 37 is applied.

In the foregoing embodiment, the image carrier cleaning device 37 is provided in such a position as to face the driven roller 24. However, the image carrier cleaning device 37 is not limited to the position facing the driven roller 24 but may be placed in any other positions where the first and second roll brushes 39 and 40 of the cleaning device 37 can have contact with the intermediate transfer belt 16.

In the above embodiment, description has been given under the assumption that the intermediate transfer belt 16 is used as the image carrier. However, the image carrier in the present invention is not limited to the intermediate transfer belt 16. Instead, any member may be used as long as it carries toner images on the surface thereof.

In the above embodiment, nylon or rayon is used as material of the brush fiber having a positive triboelectric charge polarity against toner. Also, polyester, polyethylene or Teflon is used as material of the brush fiber having a negative triboelectric charge polarity against toner. However, these materials are by way of examples only, and other materials can be used. In that case, to determine whether the triboelectric charge polarity of brush fiber against toner is positive or negative, the brush fiber should be rubbed with the toner, and then the charged polarity of the brush fiber against the toner should measured by using, for example, "Espart Analyzer" made by Hosokawa Micron Corporation.

As is already described, the beltless tandem-type image forming apparatus according to the present invention, comprises:

a movable image carrier for carrying a toner image on a surface of the image carrier;

a first roll brush including a first rotating shaft and a first brush fiber planted on the first rotating shaft so as to radially extend and have rotational contact with the surface of the image carrier;

a first bias application section for applying a bias to the first roll brush;

a second roll brush including a second rotating shaft and a second brush fiber planted on the second rotating shaft so as to radially extend and have rotational contact with the surface of the image carrier, the second roll brush being placed downstream of the first roll brush in a moving direction of the image carrier; and a second bias application section for applying a bias to the second roll brush, wherein a triboelectric charge polarity of the first brush fiber against the toner is different from a triboelectric charge polarity of the second brush fiber against the toner, wherein the first bias application section applies a bias having a polarity identical to the triboelectric charge polarity of the first brush fiber against the toner, and the second bias application section applies a bias having a polarity identical to the triboelectric charge polarity of the second brush fiber against the toner.

According to the above configuration, the first and second bias application sections apply biases having different triboelectric charge polarities from each other to the first and second roll brushes, respectively. Therefore, the first roll brush cleans one of positively charged toner and negatively charged toner, and the second roll brush cleans the other of positively charged toner and negatively charged toner.

Also, the first and second bias application sections respectively apply biases identical to the triboelectric charge polarities of the first and second brush fibers against the toner to the first and second roll brushes. Therefore, rubbing between the toner and the first or second brush fibers allows an electric charge having identical polarity to the original to be injected into the toner to be cleaned by the first or second roll brush. Consequently, this enlarges a potential difference between the first roll brush and the toner to be cleaned by the first roll brush and a potential difference between the second roll brush and the toner to be cleaned by the second roll brush.

Thus, performance for cleaning the toner on the image carrier can be enhanced in both the first and second roll rushes.

In one embodiment of the image carrier cleaning device, raw yarn resistance representing resistance per unit length of raw yarn which constitutes the first brush fiber and the second brush fiber is 10 Log Ω or more and 13 Log Ω or less. Herein, 10 Log Ω and 13 Log Ω can be indicated by $10^{10}\Omega$ and $10^{13}\Omega$, respectively.

In the case where the raw yarn resistance of raw yarn which constitutes the brush fiber is smaller than 10 Log Ω, it is impossible to provide a potential difference between the toner and the brush fiber to such a degree that allows facilitated cleaning of the toner on the image carrier. In the case where the raw yarn resistance of raw yarn is larger than 13 Log Ω, electric discharge may be generated between the toner and the brush fiber.

According to this embodiment, the raw yarn resistance is 10 Log Ω or more and 13 Log Ω or less. Thus, without any electric discharge between the toner and the brush fiber, it is possible to provide a potential difference between the toner and the brush fiber to such a degree that allows facilitated cleaning of the toner on the image carrier.

In one embodiment of the image carrier cleaning device, the triboelectric charge polarity of the first brush fiber against the toner is positive, the first bias application section applies a positive bias to the first roll brush, the triboelectric charge polarity of the second brush fiber against the toner is negative, and the second bias application section applies a negative bias to the second roll brush.

According to this embodiment, a positive bias is applied to the first roll brush while a negative bias is applied to the second roll brush. Therefore, the target to be cleaned by the first roll brush, which is placed upstream in the moving direction of the image carrier, is negatively charged toner on the image carrier. On the other hand, the target to be cleaned by the second roll brush, which is placed downstream in the moving direction of the image carrier, is positively charged toner on the image carrier.

Generally, in MFP (Multi Function Peripheral) such as a color digital printer, distribution of the toner charge amount after the secondary transfer indicates that the negatively charged toner is about 70 percent and the positively charged toner is about 30 percent. Therefore, when this embodiment is applied to the intermediate transfer belt of MFP, a great amount of the negatively charged toner, which accounts for about 70 percent, can be cleaned by the first roll brush placed upstream. Thereafter, a small amount of the positively charged toner, which accounts for about 30 percent, is cleaned by the second roll brush placed downstream. In this way, efficient cleaning can be achieved.

In one embodiment of the image carrier cleaning device, the triboelectric charge polarity of the first brush fiber against the toner is negative, the first bias application section applies a negative bias to the first roll brush, the triboelectric charge polarity of the second brush fiber against the toner is positive, and the second bias application section applies a positive bias to the second roll brush.

According to this embodiment, a negative bias is applied to the first roll brush while a positive bias is applied to the second roll brush. Therefore, the target to be cleaned by the first roll brush, which is placed upstream in the moving direction of the image carrier, is positively charged toner on the image carrier. On the other hand, the target to be cleaned by the second roll brush, which is placed downstream in the moving direction of the image carrier, is negatively charged toner on the image carrier.

In this case, toner passing out through the first and second roll brushes is injected with a positive charge and positively charged by the positively biased electric field applied to the second roll brush. Therefore, the positively charged toner, which has passed out through both the roll brushes, is reversely transferred onto the photoconductor at the primary transfer position, and can be collected by the cleaning device of the photoconductor. This makes it possible to provide further sufficient cleaning performance.

The present invention also provide the image forming apparatus incorporating the above-stated image carrier cleaning device for forming an image by using an electrophotographic method.

According to this configuration, the apparatus incorporates the image carrier cleaning device which can enhance the cleaning performance of both the first roll brush and the second roll brush to clean the image carrier, so that it becomes possible to prevent degradation of the image quality of images formed by electrophotographic method and to form high-definition images.

Major effects of the invention are as follows. Biases having different triboelectric charge polarities from each other are applied to the first and second roll brushes respectively by the first and second bias application sections in the image carrier cleaning device of the present invention. Thus, the first roll brush cleans one of positively charged toner and negatively charged toner, and the second roll brush cleans the other thereof.

At that time, biases identical to the triboelectric charge polarities of the first and second brush fibers against the toner are applied to the first and second roll brushes, respectively. Therefore, by rubbing between the toner and the first or second brush fibers, an electric charge of polarity identical to the original triboelectric charge polarity is injected into the toner to be cleaned by the first roll brush or the second roll brush. Consequently, this enlarges a potential difference between the first roll brush and the toner to be cleaned by the first roll brush and a potential difference between the second roll brush and the toner to be cleaned by the second roll brush. Thus, performance for cleaning the toner on the image carrier can be enhanced in both the first and second roll rushes.

In other words, according to the present invention, it becomes possible to prevent degradation of the cleaning performance to the image carrier, which degradation is derived from the fact that the increased cleaning performance of one roll brush is counteracted by the decreased cleaning performance of the other roll brush.

Also, the image forming apparatus of the invention incorporates the image carrier cleaning device which can enhance the cleaning performance of both the first roll brush and the second roll brush to clean the image carrier. Therefore, it becomes possible to prevent degradation of the image quality of images formed by electrophotographic method and to form high-definition images.

The invention being thus described, it will be obvious that the invention may be varied in many ways. Such variations are not to be regarded as a departure from the spirit and scope of the invention, and all such modifications as would be obvious to one skilled in the art are intended to be included within the scope of the following claims.

REFERENCE SIGNS LIST

10: printer
11: image processing section
12: feed section
13: fixing section
14: control section
16: intermediate transfer belt
17Y: photoconductor drum
21Y: primarily transfer roller
24: driven roller
37: cleaning device
39: first roll brush
39*b*, 40*b*: brush fibers
40: second roll brush
41: first toner collection roller
42: second toner collection roller
43: first scraper
44: second scraper
45: first bias application device
46: second bias application device
47: toner
47*a*, 48*a*: negatively charged toners
47*b*, 48*b*: positively charged toners
49: primary transfer bias application device
50: cleaning device

CITATION LIST

Patent Literature

Reference 1: JP 10-10942 A
Reference 2: JP 2002-229344 A
Reference 3: JP 2002-207403 A

The invention claimed is:

1. An image carrier cleaning device, comprising:

a movable image carrier for carrying a toner image on a surface of the image carrier;

a first roll brush including a first rotating shaft and a first brush fiber planted on the first rotating shaft so as to radially extend and have rotational contact with the surface of the image carrier;

a first bias application section for applying a bias to the first roll brush;

a second roll brush including a second rotating shaft and a second brush fiber planted on the second rotating shaft so as to radially extend and have rotational contact with the surface of the image carrier, the second roll brush being placed downstream of the first roll brush in a moving direction of the image carrier; and a second bias application section for applying a bias to the second roll brush, wherein a triboelectric charge polarity of the first brush fiber against the toner is different from a triboelectric charge polarity of the second brush fiber against the toner, wherein the first bias application section applies a bias having a polarity identical to the triboelectric charge polarity of the first brush fiber against the toner, and the second bias application section applies a bias having a polarity identical to the triboelectric charge polarity of the second brush fiber against the toner.

2. The image carrier cleaning device set forth in claim 1, wherein raw yarn resistance representing resistance per unit length of raw yarn which constitutes the first brush fiber and the second brush fiber is 10 Log Ω or more and 13 Log Ω or less.

3. The image carrier cleaning device set forth in claim 1, wherein the triboelectric charge polarity of the first brush fiber against the toner is positive, the first bias application section applies a positive bias to the first roll brush, the triboelectric charge polarity of the second brush fiber against the toner is negative, and the second bias application section applies a negative bias to the second roll brush.

4. The image carrier cleaning device set forth in claim 1, wherein the triboelectric charge polarity of the first brush fiber against the toner is negative, the first bias application section applies a negative bias to the first roll brush, the triboelectric charge polarity of the second brush fiber against the toner is positive, and the second bias application section applies a positive bias to the second roll brush.

5. The image carrier cleaning device set forth in claim 1, further comprising:

a first toner collection roller placed parallel to the first roll brush so as to have contact with a tip of the first brush fiber of the first roll brush, wherein the bias application to the first roll brush is performed through the first toner collection roller.

6. The image carrier cleaning device set forth in claim 1, wherein a second toner collection roller placed parallel to the second roll brush so as to have contact with a tip of the second brush fiber of the second roll brush, wherein the bias application to the second roll brush is performed through the second toner collection roller.

7. The image carrier cleaning device set forth in claim 1, wherein nylon is included in material having a positive polarity of triboelectric charge against toner and used for the first brush fiber of the first roll brush or the second brush fiber of the second roll brush.

8. The image carrier cleaning device set forth in claim 1, wherein polyester is included in material having an negative triboelectric charge polarity against toner and used for the first brush fiber of the first roll brush or the second brush fiber of the second roll brush.

9. An image forming apparatus incorporating an image carrier cleaning device for forming an image by using an electrophotographic method, the image carrier cleaning device comprising:

a movable image carrier for carrying a toner image on a surface of the image carrier;

a first roll brush including a first rotating shaft and a first brush fiber planted on the first rotating shaft so as to radially extend and have rotational contact with the surface of the image carrier;

a first bias application section for applying a bias to the first roll brush;

a second roll brush including a second rotating shaft and a second brush fiber planted on the second rotating shaft so as to radially extend and have rotational contact with the surface of the image carrier, the second roll brush being placed downstream of the first roll brush in a moving direction of the image carrier; and a second bias application section for applying a bias to the second roll brush, wherein a triboelectric charge polarity of the first brush fiber against the toner is different from a triboelectric charge polarity of the second brush fiber against the toner, wherein the first bias application section applies a bias having a polarity identical to the triboelectric charge polarity of the first brush fiber against the toner, and the second bias application section applies a bias having a polarity identical to the triboelectric charge polarity of the second brush fiber against the toner.

10. The image forming apparatus set forth in claim 9, wherein raw yarn resistance representing resistance per unit length of raw yarn which constitutes the first brush fiber and the second brush fiber is 10 Log Ω or more and 13 Log Ω or less.

11. The image forming apparatus set forth in claim 9, wherein the triboelectric charge polarity of the first brush fiber against the toner is positive, the first bias application section applies a positive bias to the first roll brush, the triboelectric charge polarity of the second brush fiber against the toner is negative, and the second bias application section applies a negative bias to the second roll brush.

12. The image forming apparatus set forth in claim 9, wherein the triboelectric charge polarity of the first brush fiber against the toner is negative, the first bias application section applies a negative bias to the first roll brush, the triboelectric charge polarity of the second brush fiber against the toner is positive, and the second bias application section applies a positive bias to the second roll brush.

13. The image forming apparatus set forth in claim 9, wherein a first toner collection roller placed parallel to the first roll brush so as to have contact with a tip of the first brush fiber of the first roll brush, wherein the bias application to the first roll brush is performed through the first toner collection roller.

14. The image forming apparatus set forth in claim 9, wherein a second toner collection roller placed parallel to the second roll brush so as to have contact with a tip of the second brush fiber of the second roll brush, wherein the bias application to the second roll brush is performed through the second toner collection roller.

15. The image forming apparatus set forth in claim 9, wherein nylon is included in material having a positive polarity of triboelectric charge against toner and used for the first brush fiber of the first roll brush or the second brush fiber of the second roll brush.

16. The image forming apparatus set forth in claim 9, wherein polyester is included in material having an negative triboelectric charge polarity against toner and used for the second brush fiber of the second roll brush or the first brush fiber of the first roll brush.

* * * * *